United States Patent [19]

Barthel

[11] Patent Number: 4,504,174

[45] Date of Patent: Mar. 12, 1985

[54] ELONGATED ELEMENTS OF PRE-STRESSED CONCRETE, ADAPTED TO BE ASSEMBLED END TO END

[75] Inventor: Pierre Barthel, conches, France

[73] Assignee: Freyssinet International (STUP), Boulogne-Billancourt, France

[21] Appl. No.: 455,518

[22] Filed: Jan. 4, 1983

[30] Foreign Application Priority Data

Jan. 11, 1982 [FR] France ..... 82 00294

[51] Int. Cl.[3] ..... E02D 5/58

[52] U.S. Cl. ..... 405/252; 52/726; 405/256

[58] Field of Search ..... 405/250, 251, 252, 256, 405/257; 52/223 R, 726; 403/335, 338

[56] References Cited

U.S. PATENT DOCUMENTS 2,759,332 8/1956 Lloyd ..... 405/252

2,988,794 6/1961 Gutt ..... 52/223 R X 3,930,373 1/1976 Wahman ..... 405/252

3,931,716 1/1976 Payne ..... 405/252

FOREIGN PATENT DOCUMENTS 12254 6/1980 European Pat. Off. ..... 405/252

*Primary Examiner*—David H. Corbin

*Attorney, Agent, or Firm*—Ned L. Conley; David A. Rose; William E. Shull

[57] ABSTRACT

The present invention relates to elongated elements of concrete pre-stressed by tensioned reinforcements adherent to this concrete. Each element comprises a box capping its end to which the reinforcements are fixed and which is provided with a flange allowing tensioning of the reinforcements and the possible assembly of two elements end to end. The invention is applicable to all structures formed by elements pre-stressed by adherent reinforcements, and in particular to driven-in piles.

6 Claims, 4 Drawing Figures

ELONGATED ELEMENTS OF PRE-STRESSED CONCRETE, ADAPTED TO BE ASSEMBLED END TO END

BACKGROUND OF THE INVENTION

The present invention relates to elongated, generally prismatic or cylindrical elements, made of pre-stressed concrete, which, by a simple arrangement, may be assembled end to end.

It is known that mass-production of elongated elements of pre-stressed concrete, especially those whose section is relatively small, is advantageously obtained with adherent reinforcements; to this end, the reinforcements are initially tensioned and the concrete is cast in shutterings through which these tensioned reinforcements pass; after the concrete has set, the connections of the reinforcements with the tensioning members are released which, by adherence, transfers the force of tension of the steel reinforcements to the concrete. Operation generally takes place on "long forms", of the order of one hundred and fifty meters, along which are disposed series of moulds through which pass, in file, the tensioned reinforcements from the ends of the form. After setting and hardening of the concrete, the reinforcements are cut between the moulds at right angles to the penetration thereof in the cast pieces.

it is difficult and delicate operation to assemble two concrete elements thus produced end to end without loosing the efficacy of the pre-stress on either side of the assembly. In fact, it is known that the complete tension of the or each reinforcement is re-established, after they have been cut at right angles to one face of the element, only to a certain depth (for example 10 to 20 cm) inside this element. The end of the element is therefore not pre-stressed. Moreover, after cutting, the anchoring of the reinforcements results, at these ends, only from the increase in their section due to the loss of the tension which drew them; in the case of alternate efforts, the loss of tension may propagate towards the inside of the element, increasing the length thereof which is not pre-stressed.

Finally, this weakening of the ends renders the end-to-ends assembly of the elements, for example sections of piles, even more precarious.

One known way of overcoming these drawbacks consists in providing the ends of such elements with steel plates through which the tensioned reinforcements pass at manufacture and which comprise, towards the inside of the element, sections of ordinary reinforcements welded to the inner face of these plates. These complementary reinforcements reinforce the non-prestressed ends of the element whilst the plates may facilitate end-to-end assembly of the elements.

The invention provides an improved solution to this problem.

SUMMARY OF THE INVENTION

According to the invention, the two ends of the sections of adherent reinforcements corresponding to the same elongated element are rendered fast with two frames whose contour corresponds to the section of this element, which frame, after tensioning of the reinforcements via said frames then concreting of the element, are permanently incorporated in the ends of this element, the frames having the form of boxes constituting the ends of the finished element; the fixations of the reinforcements are inside these boxes; thus the concrete inside the boxes is both compressed by the tension of the reinforcements and banded by the periphery of these boxes.

To facilitate connection of the reinforcements and the frames, these frames, cut to the exact length, are provided at their ends (by forging, welding, crimping, etc.) with a robust lug and the frame comprises notches whose width is just equal to the diameter of the reinforcements which, consequently, retain the lugs.

In order to facilitate tensioning of the reinforcements and also possible assembly of two elements end to end, the frames are provided on their outside with assembly members, for example flanges or lugs adapted to receive fixing means such as flanges, bolts, hoocks, etc.

In an advantageous embodiment which presents the advantage of not increasing the section of two assembled elements locally, the end boxes comprise flat-headed mushroom-shaped extensions which, applied against one another, may be assembled by a collar. The inset edges of these mushroom caps are preferably inclined so that, by the wedge effect, the tightening of the collar strongly applies the flat heads against one another.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
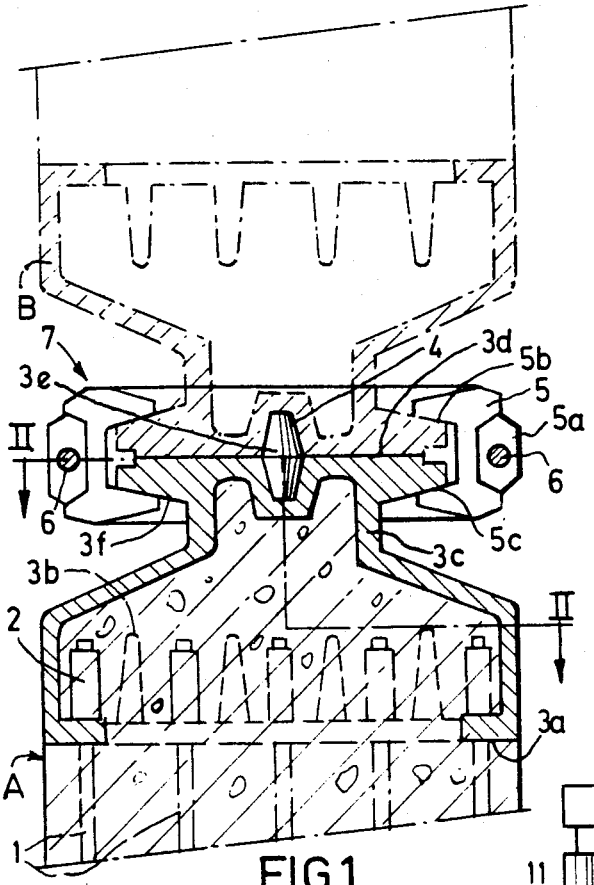
FIG. 1 is a median section of an element end, also showing the connection of two elements.
Figure 2:
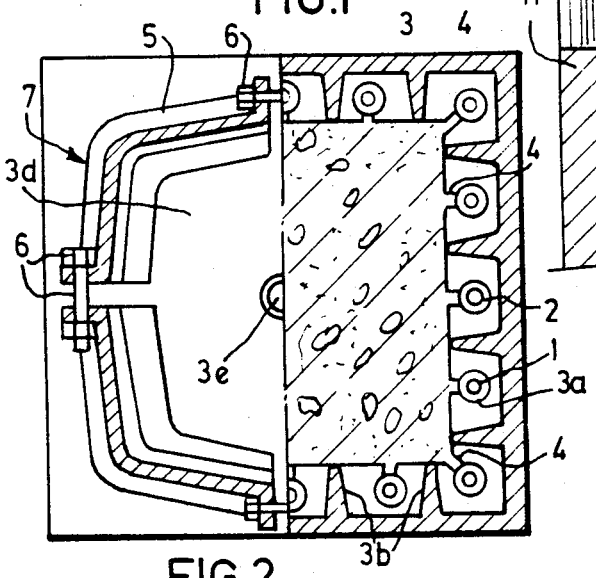
FIG. 2 is a section along II—II of FIG. 1.

Referring now to the drawings, the end of element A, shown in FIGS. 1 and 2, is pre-stressed by the adherent reinforcements 1 which are provided at their ends with crimped heads 2.

This end is capped by a box 3 provided with an inset edge 3*a* in which are formed notches 4 whose width is equal to the diameter of the reinforcements 1, so that they retain the heads 2 after the reinforcements have been positioned; ribs 3*b*, cast with the box and surrounding each of the notches, reinforce the strength of the edge 3*a* having to withstand the tension of the reinforcements.

Figure 4:
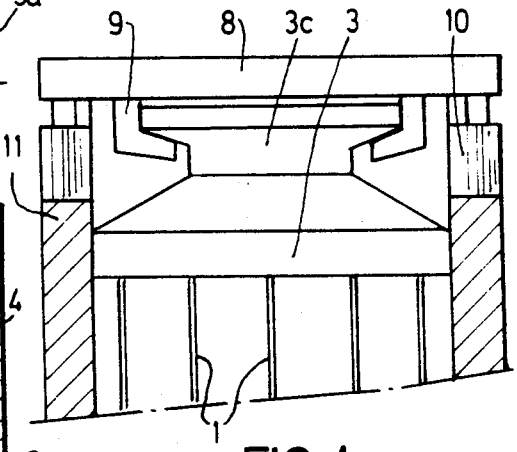
FIG. 4 schematically shows, at one of its ends, a device for manufacturing elements according to the invention.

The Figure shows an embodiment of a box 3 allowing two elements to be assembled end to end by means which do not project beyond the section of the assembled elements, as is the case for example for piles formed by successive elements. In the contrary case, the box 3 may be provided on its periphery with flanges or the like which, as will be shown in FIG. 4, are used for tensioning the reinforcements.

In the example shown, the box is extended by a head 3*c* generally in the form of a mushroom whose outer face is flat, so as to be intimately applied against the similar face of an element such as B intended to be assembled with element A; the centre of the head comprises a recess 3*e* for housing a lug 4 which centres the heads with respect to one another.

The inner edge 3*f* of the head is oblique with respect to the flat face 3*d* and, moreover, the head 3*d* has, seen in plan (FIG. 2), an octogonal form close to square. Two coupled heads may thus be assembled by a frame-shaped collar 7 formed by four parts 5 assembled by bolts 6 engaged in the flanges 5*a* which terminate the parts of frames 7. Each of the parts 5 comprises two opposite oblique faces 5*b* and 5*c* which grip around the faces 3*f* of the coupled heads; moreover, the obtuse-angled form of the parts 5, adapted to the shape in plan of the angles of the head ensure a double effect of gripping on the heads 3*c* by radial and longitudinal slide of the gripping faces 5*b* and 5*c* against the corresponding faces 3*f*, during tightening of the bolts 6.

Finally, the concrete of each element, outside the box, is pre-stressed by the reinforcements 1; the concrete inside the box is handed by this box (and also partially pre-stressed by the elastic deformation of the box when the reinforcements are tensioned); the flat faces 3*d* of the heads ensure transmission from one element to the other of the efforts of compression; the frame 7 withstands the efforts of traction between elements and also, due to its shape, the efforts of torsion; finally, the lug 4 withstands the possible efforts of shear between elements.

Figure 3:
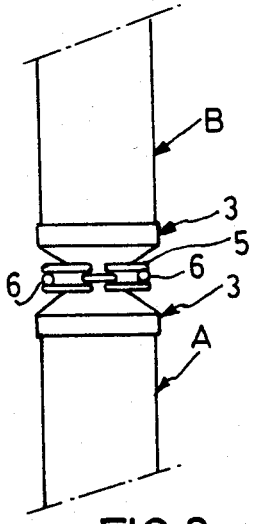
FIG. 3 partially shows a pile comprising two assembled elements.

As shown in FIG. 3, the embodiment shown in FIGS. 1 and 2 is particularly adapted to making long piles formed by elements such as A and B, their assembly comprising non lateral projection which might hinder driving in of the pile. The invention also enables continuous beams to be made from elements pre-stressed by adherent reinforcements; in this case, the box may be directly terminated by a flat face provided with a flange similar to that of head 3*c* as, in this case, the assembly means may project without inconvenience.

Such flanges (those of a head or those of a box edge) allow the reinforcements 1 to be tensioned when an element is being manufactured, as shown in FIG. 4

A trimmer joist 8 provided with hooks 9, adapted to the shape of the flange, is urged by jacks 10, abutting on a rigid structure 11 which may be the mould of the element itself. At the other end, the box 3 may be immobilized by passive means. After the reinforcements have been tensioned, the concrete is cast into the mould until it hardens, this allowing the tensioning means to be released. Of course, the trimmer joist 8 may be associated with a plurality of laterally coupled moulds, which enables a large number of elements to be manufactured simultaneously.

The invention is applied both to separate elements (beams, piles, railway ties or sleepers) comprising adherent armatures and to complex structures formed by elements of this type, assembled.

What is claimed is:

1. Apparatus for assembling two elongated elements of concrete pre-stressed by a plurality of tensioned reinforcements molded in and adherent to said concrete, said reinforcements each having terminal lugs mounted on their ends, said lugs having a diameter larger than that of said reinforcements, comprising two frames, each frame being disposed on and enclosing the end portion of one of said elements, each of said frames having an inner end and an outer end, each of said frames having on its inner end an inwardly turned flange molded and embedded in the respective concrete element, each of said flanges having a plurality of spaced-apart notches therein for housing the ends of said reinforcements and for hooking and retaining said terminal lugs, the width of said notches being substantially the same as the diameter of said reinforcements, and each of said frames having on its outer end means for attaching said outer end to the outer end of the other of said frames, said frames therefore being adapted for holding said reinforcements while said reinforcements are being tensioned and after the concrete comprising said elements has cured.

2. Apparatus according to claim 1, each of said frames having an inner face, and further comprising a plurality of ribs disposed on said flange of each of said frames between said notches and connecting said flange to the inner face of each of said frames for increasing the strength of said flanges and withstanding the tension of said reinforcements.

3. Apparatus according to claim 2, wherein said concrete elements have a common cross-sectional size and said means for attaching the outer ends of said frames together lies substantially within the contour of the common cross section of said concrete elements.

4. A frame for enclosing the end portion of an elongated, pre-stressed concrete element having a plurality of tensioned reinforcement members molded therewithin, said reinforcement members having lugs disposed on their ends, said lugs having a diameter larger than that of said reinforcement members, comprising:

a box member having one open end disposed over and enclosing said end portion of said concrete element;

an inwardly projecting, inset edge integral with and disposed around the periphery of said open end of said box member and embedded in said concrete element, said inset edge having an inner face disposed toward the interior of said box member; and a plurality of spaced-apart notches disposed around said inset edge, there being at least one notch for each of said reinforcement members, each of said reinforcement members being housed within one of said notches with said lugs being disposed upon and supported by said inner face of said inset edge.

5. Frame according to claim 4, wherein the end of said box member opposite to said open end includes means for attaching said box member to a corresponding box member end of a second concrete element having a second said frame disposed thereon.

6. Frame according to claim 4, said box member having side walls each with an inside surface, and further including ribs fixed to said inner face of said inset edge, one rib being disposed between each pair of adjacent ones of said notches, each of said ribs being attached to the inside surface of the corresponding one of said side walls for strengthening said inset edge for withstanding the force exerted thereon by said tensioned reinforcement members.

* * * * *

UNITED STATES PATENT AND TRADEMARK OFFICE

CERTIFICATE OF CORRECTION

PATENT NO. : 4,504,174

DATED : MARCH 12, 1985

INVENTOR(S) : PIERRE BARTHEL

It is certified that error appears in the above—identified patent and that said Letters Patent is hereby corrected as shown below:

Column 1, line 28: change "it is difficult" to

--It is a difficult --.

Column 2, line 14: change "hoocks" to --hooks --.

Column 2, line 57: before and after "for example"

insert --, --.

Column 3, line 17: change "handed" to --banded --.

Signed and Sealed this

*Fifteenth* Day of *October 1985*

[SEAL]

*Attest:*

*Attesting Officer*

DONALD J. QUIGG

*Commissioner of Patents and Trademarks—Designate*